US006698599B1

(12) United States Patent
Hannecke

(10) Patent No.: US 6,698,599 B1
(45) Date of Patent: Mar. 2, 2004

(54) DEVICE FOR DISPLAYING FLAT AND FLEXIBLE OBJECTS

(75) Inventor: Wolf-Dietrich Hannecke, Northeim (DE)

(73) Assignee: Wolf-Dietrich Hannecke Kunststofftechnik (DE)

( * ) Notice: Subject to any disclaimer, the term of this patent is extended or adjusted under 35 U.S.C. 154(b) by 0 days.

(21) Appl. No.: 09/341,729

(22) PCT Filed: Jan. 13, 1998

(86) PCT No.: PCT/EP98/00138

§ 371 (c)(1),
(2), (4) Date: Aug. 27, 1999

(87) PCT Pub. No.: WO98/31263

PCT Pub. Date: Jul. 23, 1998

(30) Foreign Application Priority Data

Jan. 16, 1997 (DE) ..... 197 01 255

(51) Int. Cl.[7] ..... A47F 7/00
(52) U.S. Cl. ..... 211/51; 211/88.01; 206/449
(58) Field of Search ..... 211/51, 50, 88.01, 211/106; 206/449

(56) References Cited

U.S. PATENT DOCUMENTS

| | | | | | |
|---|---|---|---|---|---|
| 789,494 | A | * | 5/1905 | Garbo | 211/51 |
| 877,671 | A | | 1/1908 | Simmons | |
| 1,191,657 | A | | 7/1916 | Brady | |
| 1,192,633 | A | * | 7/1916 | Hoffman | 211/50 |
| 1,350,874 | A | * | 8/1920 | Lorange | 211/50 |
| 1,817,073 | A | * | 8/1931 | Davis | 211/50 |
| 1,838,681 | A | * | 12/1931 | Hutchings | 211/50 |
| 1,949,200 | A | | 2/1934 | Freson | |
| 1,963,544 | A | | 6/1934 | Burt | |
| 2,523,908 | A | | 9/1950 | Johnsen | |
| 2,564,518 | A | | 8/1951 | Bedinger | |
| 2,705,564 | A | * | 4/1955 | Bray | 211/51 |
| 2,761,944 | A | * | 9/1956 | Yannelli | 219/19 |
| 3,647,076 | A | * | 3/1972 | Heimann | 211/88.01 |
| 3,844,230 | A | | 10/1974 | Hudson et al. | |
| 3,921,811 | A | * | 11/1975 | Dameron | 211/43 |
| 4,049,330 | A | | 9/1977 | Schlapp | |
| 4,079,841 | A | * | 3/1978 | Castel | 211/131 |
| 4,336,759 | A | | 6/1982 | Hannecke | |
| D266,210 | S | | 9/1982 | Hannecke | |
| 4,538,751 | A | * | 9/1985 | Peterson | 215/227 |
| 4,699,277 | A | * | 10/1987 | Baxter | 211/51 |
| 4,741,438 | A | * | 5/1988 | Mastronardo et al. | 206/309 |
| 4,753,369 | A | | 6/1988 | Morrison | |
| 4,782,953 | A | * | 11/1988 | McPhee | 206/557 |

(List continued on next page.)

FOREIGN PATENT DOCUMENTS

| | | |
|---|---|---|
| DE | 82 25 277.7 | 9/1982 |
| DE | 297 551 | 10/1983 |
| DE | 89 10 867.1 | 9/1989 |
| DE | 92 17 446.9 | 12/1992 |
| DE | 295 06 656 | 4/1995 |
| DE | 44 09 328 | 9/1995 |
| DE | 197 01 257.4 | 1/1997 |
| EP | 0 102 553 | 8/1983 |
| EP | 0 417 580 | 9/1990 |
| FR | 2 282 835 | 3/1976 |
| GB | 2 027 336 | 4/1979 |

*Primary Examiner*—Blair M. Johnson
*Assistant Examiner*—Khoa Tran
(74) *Attorney, Agent, or Firm*—Schmeiser, Olsen & Watts

(57) ABSTRACT

A device for displaying flat and flexible objects. The device displays flat and flexible objects and is specially suitable for modular display systems, e.g. display racks or display consoles. Flat and specially non-rigid display goods are held upright, and can be reliably inserted and withdrawn. The bottom, the rear wall and the sidewalls are configured as a single-pieced plastic injection molded part. At least one of the sidewalls is flexibly configured at least in one of its segments as a clamp holding the inserted objects in an upright position.

7 Claims, 3 Drawing Sheets

U.S. PATENT DOCUMENTS 4,884,691 A * 12/1989 Behrens et al. ..... 206/444
4,938,365 A * 7/1990 Conway et al. ..... 211/50
4,943,024 A 7/1990 Meyer
4,976,359 A 12/1990 Hardy
5,013,074 A * 5/1991 Galle ..... 294/33
5,123,544 A 6/1992 Hannecke
5,160,027 A * 11/1992 Wu ..... 206/387
5,190,167 A * 3/1993 Andrews et al. ..... 211/50
5,312,001 A * 5/1994 Sorensen ..... 211/50
5,325,978 A * 7/1994 Rabig ..... 220/4.24
5,348,152 A * 9/1994 Kiyoshi et al. ..... 206/354
5,361,497 A * 11/1994 Crawford ..... 30/151
5,472,100 A * 12/1995 Garrison et al. ..... 211/45
5,484,064 A * 1/1996 Melichar ..... 211/50
5,774,929 A * 7/1998 Jurgens et al. ..... 100/121
5,836,459 A * 11/1998 Nezwek et al. ..... 211/50
6,026,873 A * 2/2000 Van Geer ..... 150/147
6,182,825 B1 * 2/2001 Butcher ..... 206/308.1
6,196,161 B1 * 3/2001 Thurber ..... 119/496
6,253,943 B1 * 7/2001 Spykerman et al. ..... 220/6
6,389,944 B1 * 5/2002 Davidson ..... 30/114

* cited by examiner

DEVICE FOR DISPLAYING FLAT AND FLEXIBLE OBJECTS

FIELD OF THE INVENTION

The invention relates to a device for displaying flat and flexible objects, in particular high-format recording media in the form of sheets, with an insertion compartment for receiving such objects in an upright position, said compartment being delimited by a bottom, a rear wall as well as two upright sidewalls laterally mounted on said bottom plate, and terminating in the form of a withdrawal opening in the area of the external edge of the bottom.

BACKGROUND OF THE INVENTION

Devices also referred to as merchandise supports or merchandise bags for displaying flat objects are used in the most diverse manner in entire shop fittings or in individual pieces of display furniture. The merchandise supports are mounted on carrier systems. Besides providing a supply of goods which can be taken out, these supports serve to display the range of goods in question in an appealing, space-saving way so that they can be reached easily by the customer. In this case, the goods are to be displayed such that each individual category taken alone, e.g. each title in the case of print media, will catch the eye and is readily identifiable. Above all where sales surface is scarce, display means specifically adapted to the format or the nature of the goods are becoming more and more popular. Among such display means are for example the prior art display racks but also special wall fittings and the like.

To avoid having to completely exchange display systems which are space-saving but specifically adapted to the format of the goods in question when the goods range is changed, modular systems such as the device disclosed in DE 295 06 656.3 are being used more and more. In such systems, the individual merchandise supports or merchandise bags can be detached from a piece of carrier furniture and can be replaced with different ones which are better adapted to the new goods.

Although the merchandise bags which considerably contribute to the successful and sales-promoting display of merchandise have recently been receiving more and more attention, there is a clear need for merchandise bags for thin non-rigid or not very rigid merchandise, e.g. magazines, catalogues, single sheets or also packaged tights and the like. The conventional approach, namely merely placing these display goods on a horizontal or inclined surface, is therefore still predominant although this described way of displaying the goods is relatively space-consuming and basically inappropriate for goods of the low-price category which they mainly are.

If the merchandise or the display goods of the mentioned category are to be displayed upright in a space-saving manner in e.g. a transparent insertion compartment which can be mounted on a display rack or a wall fitting, one problem which arises is that magazines, sheets and the like contained in an insertion compartment will only retain their upright position if the compartment is filled to the edge. Otherwise, they will fall to the side or collapse—which is not only detrimental to the display effect, but frequently also results in creases or crinkles, undulations and other damage affecting the sales value of the goods. It has been tried to solve this problem as described in DE-U-82 25 277 or DE-U-89 10 867 by means of mechanical clamping springs or movable and spring-biased side walls incorporated in the merchandise bags. Although the proposed means are substantially capable of solving this problem, the described solution approaches are too complex and too expensive to also be used in modular systems or for the display of low-value or free-of-charge merchandise or pamphlets, information sheets and the like.

SUMMARY OF THE INVENTION

It is the object of the invention to provide an inexpensive and simple device for displaying flat and flexible objects (merchandise bag) which is specially suited for use in modular display systems, e.g. for display racks or display consoles, and in which flat display goods, in particular of low rigidity, are always kept upright, and which can be reliably inserted in the insertion compartment as well as withdrawn again therefrom.

This object is accomplished according to the invention by the features of claim 1.

An advantage of the invention is that it is simple in manufacture since the new display device is a single-pieced plastic injection molded part which already includes clamps in its unprocessed state. Nothing but a subsequent second step is required to give the clamps the required curvature which is suitably done by means of one of the prior art thermal shaping processes. The mass production made possible thereby results in extremely low production costs of the inventive display device, thus making it particularly suitable for use in modular display systems. It may even be possible to package certain goods in the inventive merchandise bag ex factory and dispatch them to the retailer in such state, i.e. complete with bag. Empty merchandise bags can be returned and easily recycled since they are made of one single plastic material.

In accordance with a preferred embodiment of the invention, the clamps are formed as a freely extension from an upper portion of the sidewalls. In the area of the withdrawal opening, they are connected to the main surface of the sidewalls or merge into them and are furthermore curved so as to converge in the direction of the rear wall. The fact that the goods inserted into the compartment are only clamped and held upright in the area of the rear wall makes it easy to introduce them into the compartment. In this manner, the slightly curved clamps not only serve as a support of the inserted goods, but also as guiding means. A further advantage of the invention is that the inserted goods will have sufficient play in the area of the withdrawal opening where they are not pressed onto each other, thus making it possible to securely grasp and take out single items. Contrary to the prior art spring-biased merchandise bags, the goods are clamped where it is desired—if no filling funnel is used—namely at the top and at the rear portion of the merchandise bag. Since the hinges of prior art merchandise bags are always located in the stable rear area of the merchandise bag, the motion axis of the clamping spring will always be behind it, viewed from the withdrawal opening, which is rather disadvantageous with respect to the reliable guiding and ease of withdrawal of the goods.

In accordance with an advantageous further development of the abovementioned embodiment, the strip-like clamps are inclined upward, viewed from the withdrawal opening. This feature entails the major advantage that the clamps can be made longer in their entirety than would be possible if they extended horizontally. Consequently, this leaves more space for their curvature. The spring force can be diminished as a function of the material thickness so as to prevent the goods from being creased or damaged upon insertion.

Viewed from above, an advantageous curvature of the clamps extends roughly in the shape of an S, which results in two opposing clamps extending almost in parallel at the area where they merge with the sidewall and at the area where they converge and come together. When the goods are introduced, these will automatically be pulled upward somewhat, following the course of the clamps, so as to prevent the goods from becoming jammed on the bottom. Moreover, owing to the strip form of the clamps, the introduced goods will meet a uniform and relatively small resistance so that this feature, too, facilitates guiding and withdrawal of the goods.

Inserting and withdrawing goods can be facilitated even further if the sidewalls are flared outward at the withdrawal opening.

According to another preferred embodiment, both sidewalls are flexibly configured at least in one of their segments as clamps, and in the unloaded state, if viewed parallel to the bottom, extend in a manner seemingly constricting the insertion compartment. This makes it possible to reach high clamping forces—which in turn ensures that even heavy objects will be held securely. Moreover, such devices are very robust since they do not have any freely terminating elements which might break off.

While the constricted portion makes it harder to insert objects in the direction parallel to the bottom, inserting objects from above in the direction toward the bottom is actually facilitated thereby. This effect is even enhanced when the ends of the sidewalls opposing the bottom are flared or fanned to the outside much in the manner of a filling funnel.

If the bottom at the area of the insertion compartment includes longitudinal flutes or fine webs, this on the one hand improves the guidability of the goods, and on the other hand prevents the goods from slipping away to the side—thus further improving stability.

For the purpose of improving transparency and above all for reducing weight and costs, it is advantageous if the sidewalls have large openings in the material. This can also influence the flexibility of the sidewalls.

Furthermore, it is particularly advantageous if the one-pieced merchandise bags include attachment means integrated in the area of the rear wall and serving to attach the bags to a provided support system. For modular systems, push or reception profiles for a dovetail profile are advantageously provided which also include a safety latch, if necessary.

Even if the advantages of the invention are also obtained if segments of only one sidewall are formed as a clamp, it will prove more advantageous in general if both sidewalls include clamps.

BRIEF DESCRIPTION OF THE DRAWINGS

The invention is set out in more detail hereinafter with reference to two particularly preferred embodiments illustrated in the drawings, of which

DETAILED DESCRIPTION OF THE INVENTION

Figure 1:
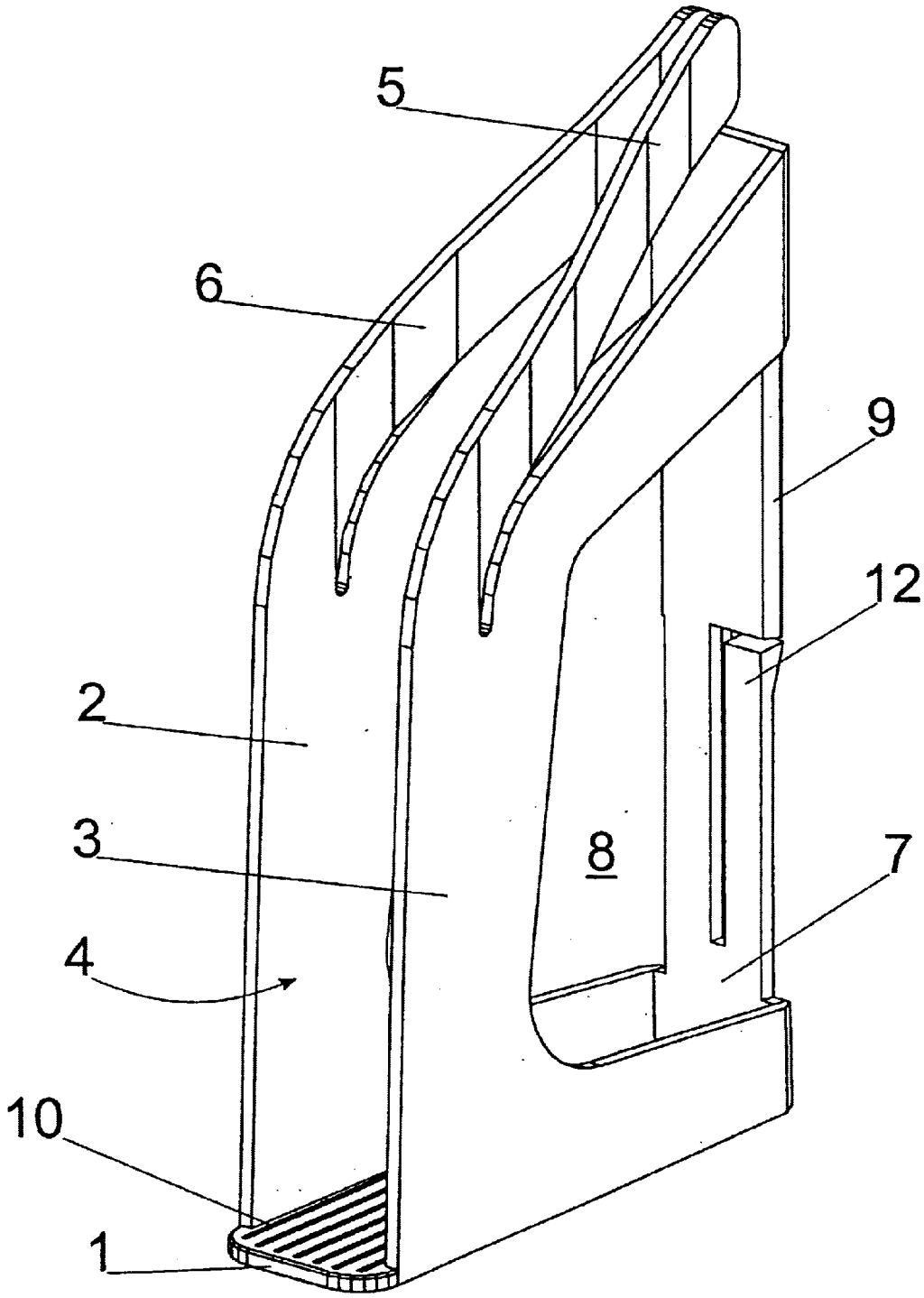
FIG. 1 is a perspective front view of a first embodiment of a device according to the invention.
Figure 2:
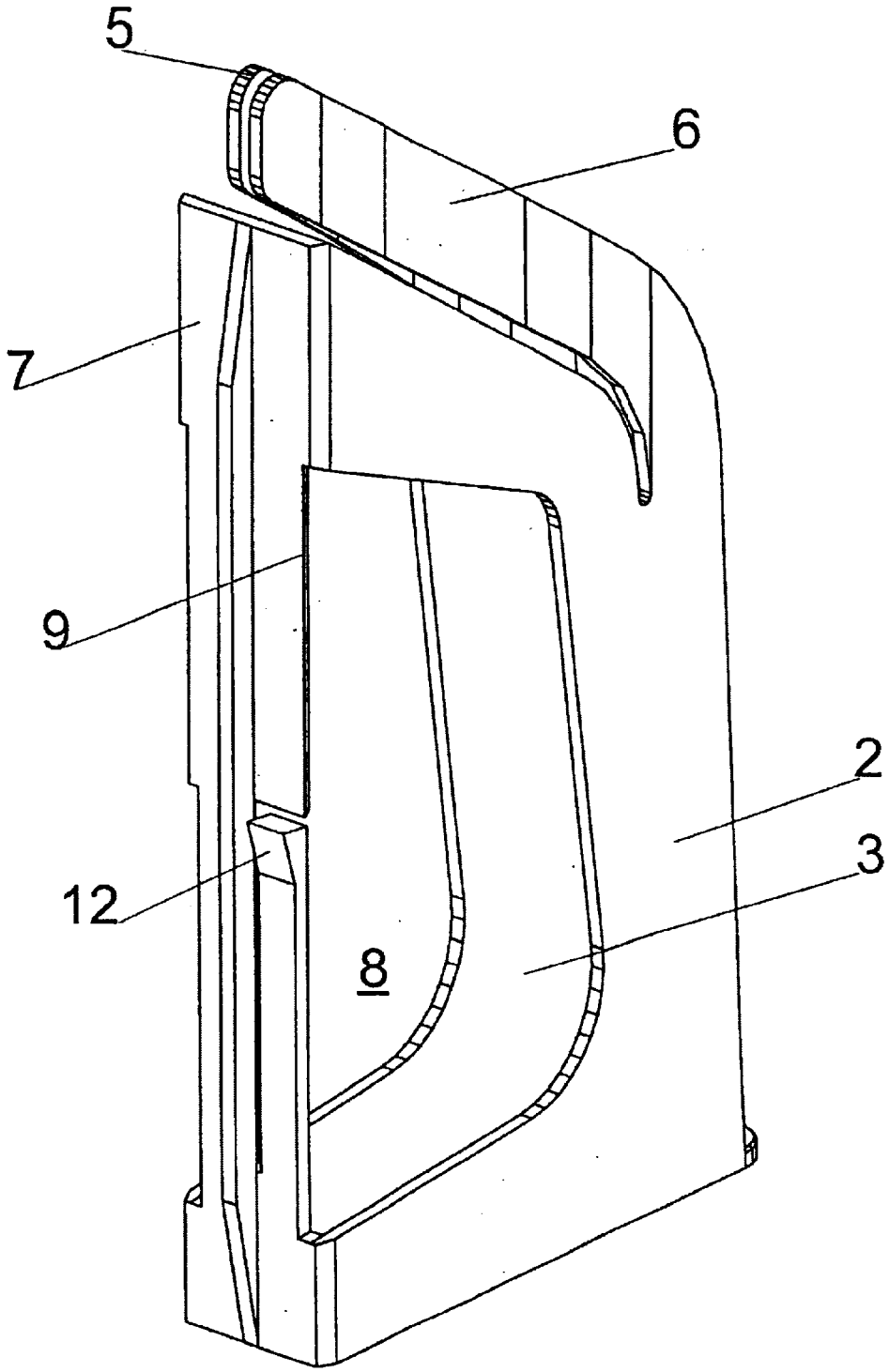
FIG. 2 is a perspective rear view of the device of FIG. 1.

The merchandise bag shown in FIGS. 1 and 2 and made of a single plastic injection molded part (device for displaying flat and flexible objects) comprises a bottom 1, a rear wall 7 as well as two sidewalls 2, 3 extending perpendicular from said bottom 1, thus forming an insertion compartment with a withdrawal opening 4 for receiving flat display goods therein. From the rear wall 7, the two upper edges of the main surfaces of the sidewalls 2, 3 incline downward toward the bottom plane in the direction to the withdrawal opening. The respective upper segment of the sidewalls 2, 3 is in the form of a clamp 5, 6, respectively. The two clamps 5, 6 are in the form of strip-shaped material segments, inclining upward substantially in parallel to the upper edges of the main surface, as viewed from the withdrawal opening 4. In this way, when goods are filled into the merchandise bag, the display goods are brought into the desired position smoothly and without much resistance, at the same time avoiding jamming of the goods on the bottom.

At the withdrawal opening 4, both clamps 5, 6 merge with the respective main surface of the sidewall 2, 3 and extend slightly S-shaped toward each other in the direction of the rear wall 7. In this way, the clamping effect of the two clamps 5, 6 is exerted on the upper portion of the inserted goods, thus always holding them in the desired upright position even if they are almost non-rigid. As can be seen from the drawings, the invention is particularly suitable for the display of high-format objects such as folded city maps, maps in general and the like. The fact that the goods are merely clamped and pressed together at the rear portion of the insertion compartment, they have enough play at the withdrawal opening 4 to ensure that they can be securely grasped for withdrawal as well as re-inserted between the other goods without damage.

The bottom 1 has fine longitudinal webs 10 preventing the inserted goods from slipping to the side and improving their guidance.

The sidewalls 2, 3 moreover exhibit large openings 8—which saves weight and material and improves the visibility of the goods surfaces. The angle and radii of the rounded-off segments of the large openings have been chosen such that the goods will not abut anywhere and become damaged upon insertion.

The upper half of the segment of the rear wall 7 delimited by the openings 8 is formed as a push profile 9 which, when inserted into a matching reception profile of a random support means, will form a form-fit dovetail profile. The dovetail profile is subsequently reliably secured by the snap-in latch 12.

Figure 3:
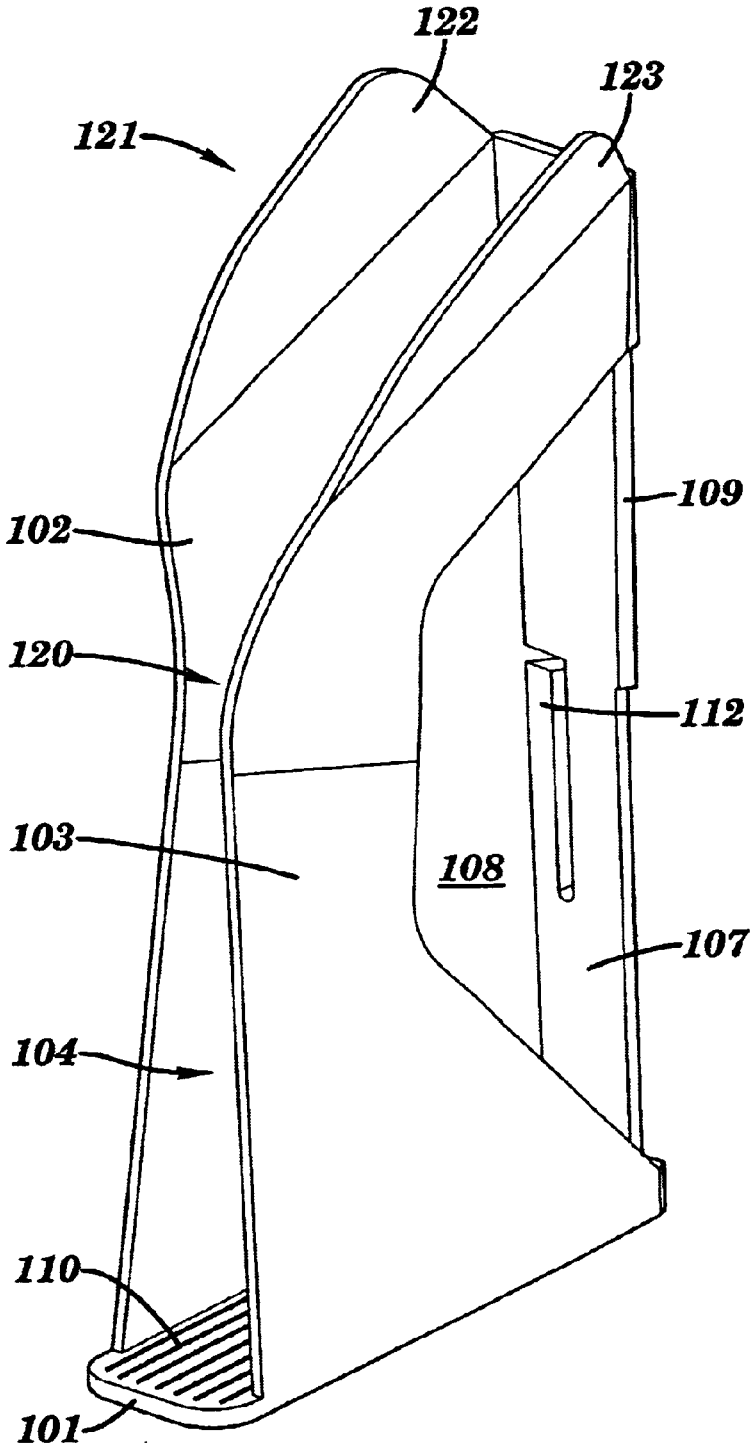
FIG. 3 is a perspective front view of a second embodiment of a device according to the invention.

The second embodiment of a device according to the invention as shown in FIG. 3 merely differs from the device according to the first embodiment of FIGS. 1 and 2 by the design of the sidewalls 102, 103 so that the reference numerals used to designate elements of said device which correspond to elements of the device according to the first embodiment are increased by 100 compared to the reference numerals of FIGS. 1 and 2. Reference is hereby made to the respective parts of the description.

In contrast to the device according to the first embodiment, the device according to the second embodiment, likewise a merchandise bag, has sidewalls 102, 103 which are flexibly configured in their entirety. In an injection molding step, the sidewalls 102, 103 were shaped to have a constricted portion 120 at the withdrawal opening 104. Consequently, the opening width of the withdrawal opening 104 at said constricted portion 120 is only about one third of the width of the withdrawal opening 104 at the bottom 101 of the device.

In order to facilitate the insertion of objects into the device, the device according to the second embodiment has a filling funnel 121 at its upper end opposite its bottom 1 which funnel is formed by outwardly flared upper sidewall sections 122, 123. The upper sidewall sections 122, 123 are inclined by approx. 15° compared to the plane of the sidewalls.

The funnel shape of the upper sidewalls is obtained by the design of the steel mold for the injection molding process, just as the funnel shape and the constricted portion (of the flexibly configured sidewalls) are obtained in one single operation by means of the steel mold and the injection molding process. This manufacturing process can also be used for the device according to the first embodiment.

In order to avoid excessive material stresses in the case of deformations when objects are inserted into the bags, the upper sidewall sections 122, 123 are not connected to the rear wall 107. The geometrical shape and the geometrical location of the two funnel elements have been chosen such that the funnel function is also maintained when the constricted portion unbends itself.

What is claimed is:

1. A merchandise box for displaying flat and flexible objects, comprising an insertion compartment for receiving the objects in an upright position, said compartment further comprising a bottom, a rear wall and two sidewalls extending laterally on said bottom and terminating in a withdrawal opening at an exterior edge of the bottom; the bottom, the rear wall and the sidewalls being formed as a single-piece plastic injection molded part, wherein both sidewalls are flexibly configured as clamps for holding the inserted objects in an upright position, both sidewalls including constricted portions which extend inwardly toward each other.

2. The merchandise box of claim 1 wherein an attachment device is integrated within, and substantially coplanar with, the rear wall, for attaching the merchandise box to a support.

3. The merchandise box of claim 2 wherein the attachment further includes a safety latch.

4. The merchandise box of claim 1 wherein the sidewalls are flared outward at ends opposite the bottom.

5. The merchandise box of claim 1 wherein the bottom has longitudinal flutes in the insertion compartment.

6. The merchandise box of claim 1 wherein the sidewalls further include openings therein.

7. A merchandise box for displaying flat and flexible objects, comprising:

a bottom;

a rear wall; and a pair of sidewalls attached to the bottom and rear wall, both sidewalls including constricted portions which extend inwardly toward each other, wherein at least one of the sidewalls is flexibly configured as a clamp to hold inserted objects in an upright position, and wherein the bottom, the rear wall and the sidewalls are formed as a single-piece plastic injection molded part.

* * * * *

UNITED STATES PATENT AND TRADEMARK OFFICE

CERTIFICATE OF CORRECTION

PATENT NO. : 6,698,599 B1
DATED : March 2, 2004
INVENTOR(S) : Hannecke

It is certified that error appears in the above-identified patent and that said Letters Patent is hereby corrected as shown below:

Title page,
Item [30], Foreign Application Priority Data, delete "197 01 255.8" and insert -- 197 01 255.8 --

Column 1,
Lines 17, 39, 42 and 45, delete the word "bags" and insert -- boxes --
Line 52, delete "category which" and insert -- category of which --

Column 2,
Line 1, 32, 51 and 54, delete "bags" and insert -- boxes --
Line 11, delete "(merchandise bag) and insert -- (i.e., a merchandise box) --
Line 18, delete "the features of claim 1." and insert -- merchandise box for displaying flat and flexible objects, comprising an insertion compartment for receiving the objects in an upright position, said compartment further comprising a bottom, a rear wall and two perpendicular sidewalls extending laterally on said bottom and terminating in a withdrawal opening at an exterior edge of the bottom; the bottom, the rear wall and the sidewalls being formed as a single-piece plastic injection molded part, wherein both sidewalls are flexibly configured as clamps for holding the inserted objects in an upright position, both sidewalls including constricted portions which extend inwards. --
Line 20, delete "in" and insert the word -- to --
Line 25, delete "prior" and insert the word -- related --
Line 30, delete "bag" and insert the word -- box --
Line 32, delete "bag" and insert -- a merchandise box --
Line 32, delete "bags" and insert -- boxes --
Line 35, delete a "preferred" and insert -- an --
Line 36, delete "freely" and insert -- free --
Lines 50 and 53, delete "prior" and insert -- related --
Line 53 and 55, delete "bag" and insert -- box --
Line 56, delete "it, viewed" and insert -- it, as viewed --
Line 61, delete "upward, viewed" and insert -- upward, as viewed --
Line 62, delete "the major advantage" and insert -- the advantage --

Column 3,
Line 7, delete "so as to prevent" and insert -- which prevents --
Line 16, delete "preferred"
Line 17, delete "configured at" and insert -- configured in at --
Lines 42 and 44, delete "bags" and insert -- boxes --
Line 55, delete "particularly preferred" and insert -- particular --
Line 66, delete "bag" and insert -- box --

UNITED STATES PATENT AND TRADEMARK OFFICE

CERTIFICATE OF CORRECTION

PATENT NO. : 6,698,599 B1
DATED : March 2, 2004
INVENTOR(S) : Hannecke

It is certified that error appears in the above-identified patent and that said Letters Patent is hereby corrected as shown below:

Column 4,
Line 12, delete “bag” and insert -- box --
Line 31, delete “webs preventing” and insert -- webs or flutes preventing --
Line 36, delete “goods” and insert -- goods’ --
Line 55, ending with parts of the description., insert the following four paragraphs:
-- The merchandise box shown in Fig. 3, and made of a single plastic injection molded part (devise for displaying flat and flexible objects), comprises a bottom 101, a rear wall 107 as well as two sidewalls 102, 103, extending perpendicular from said bottom 101, thus forming an insertion compartment with a withdrawal opening 104 for receiving flat display goods therein. From the rear wall 107, the upper edges of the main surfaces of the sidewalls 102, 103 incline downward toward the bottom plane in the upper direction to the withdrawal opening. --

-- The bottom 101 has fine longitudinal webs or flutes 110 preventing the inserted goods from slipping to the side and improving their guidance. --

-- The sidewalls 102, 103 moreover exhibit large openings 108 - which save weight and material and improves the visibility of the goods’ surfaces. The angle and radii of the rounded-off segments of the large openings have been chosen such that the goods will not abut anywhere and become damaged upon insertion. --

-- The upper half of the segment of the rear wall 107, delimited by the openings 108, is formed as a push profile 109 which, when inserted into a matching reception profile of a random support means, will form-fit dovetail profile. The dovetail profile is subsequently reliably secured by the snap-in latch 112. --
Line 58, delete “bag” and insert -- box --

UNITED STATES PATENT AND TRADEMARK OFFICE

CERTIFICATE OF CORRECTION

PATENT NO. : 6,698,599 B1
DATED : March 2, 2004
INVENTOR(S) : Hannecke

It is certified that error appears in the above-identified patent and that said Letters Patent is hereby corrected as shown below:

Column 5,
Line 14, delete “bags” and insert -- merchandise boxes --

Signed and Sealed this

Thirty-first Day of August, 2004

JON W. DUDAS
*Director of the United States Patent and Trademark Office*

UNITED STATES PATENT AND TRADEMARK OFFICE

CERTIFICATE OF CORRECTION

PATENT NO. : 6,698,599 B1
DATED : March 2, 2004
INVENTOR(S) : Hannecke

It is certified that error appears in the above-identified patent and that said Letters Patent is hereby corrected as shown below:

Column 5,
Line 1, delete "1" and insert -- 101 --
Line 19, after the paragraph ending "portion unbends itself", insert
-- Embodiments of the present invention have been disclosed. A person of ordinary skill in the art would realize, however, that certain modifications would come within the teachings of this invention. For instance, the plastic material of which the invention is formed is not limited to a certain composition or color. Therefore, the following claims should be studied to determine the true scope and content of the invention. --

Signed and Sealed this

Fourteenth Day of December, 2004

JON W. DUDAS
*Director of the United States Patent and Trademark Office*